United States Patent [19]

Demers

[11] Patent Number: 5,056,664

[45] Date of Patent: Oct. 15, 1991

[54] CORNER PROTECTOR APPARATUS

[76] Inventor: Jean G. Demers, 5636 W. Berkeley Rd., Phoenix, Ariz. 85035

[21] Appl. No.: 541,318

[22] Filed: Jun. 21, 1990

[51] Int. Cl.[5] ..... B65D 63/00; B65D 6/34

[52] U.S. Cl. ..... 206/453; 410/99; 24/16 R; 217/69; 206/586; D8/403

[58] Field of Search ..... 206/453, 586; 410/99; 217/69

[56] References Cited

U.S. PATENT DOCUMENTS

| | | | |
|---|---|---|---|
| 969,950 | 9/1910 | Griesbeck | 217/69 |
| 1,041,413 | 10/1912 | Betham | 217/69 |
| 2,406,354 | 8/1946 | Connelly et al. | 217/69 |
| 3,073,439 | 1/1963 | Summonds, Jr. | 206/453 |
| 3,152,693 | 10/1964 | Anderson | 206/453 |
| 3,209,706 | 10/1965 | Broling | 410/99 |
| 3,973,720 | 8/1976 | Schmid | 206/586 |
| 4,011,632 | 3/1977 | MacDonald | 410/99 |
| 4,525,113 | 6/1985 | Colman | 410/99 X |
| 4,765,479 | 8/1988 | Roberts | 206/453 |
| 4,938,357 | 7/1990 | Schmidt | 206/453 |

*Primary Examiner*—William I. Price
*Attorney, Agent, or Firm*—Leon Gilden

[57] ABSTRACT

An apparatus including an elongate flexible strip longitudinally aligned, including a first and second aperture directed through the strip adjacent a forward and rear end of the strip to receive a flexible tether line therethrough to secure a stack of frangible sheets against a support platform. A modification of the invention includes removal grommets directed through the openings to vary the effective diameter of each opening, and further may include a selectively securable positioning member onto a bottom surface of the strip to assist in alignment of the strip adjacent a corner of the aforenoted stack.

5 Claims, 5 Drawing Sheets

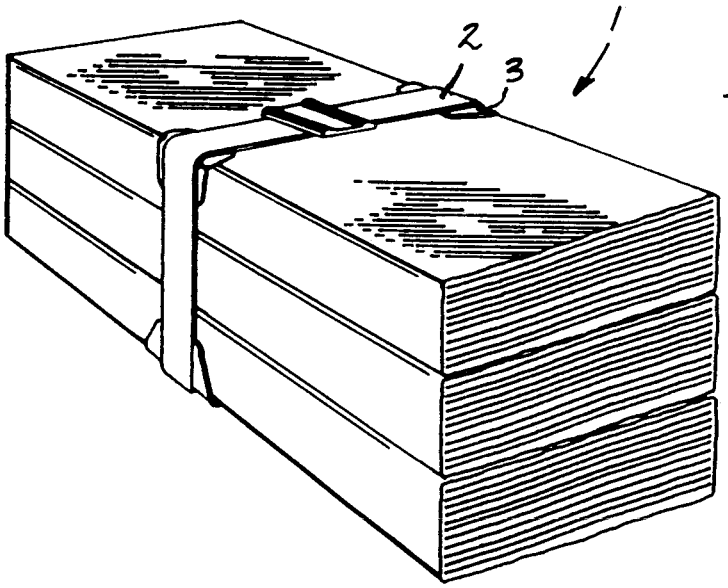
FIG. 1
PRIOR ART
FIG. 2
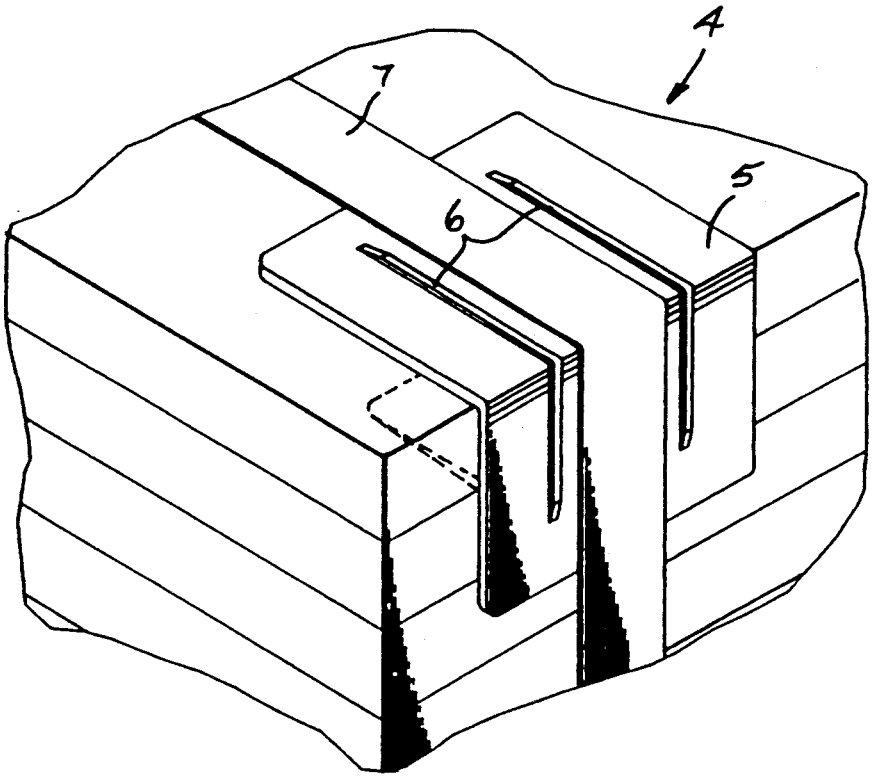
PRIOR ART

CORNER PROTECTOR APPARATUS

BACKGROUND OF THE INVENTION

1. Field of the Invention

The field of invention relates to corner protector apparatus, and more particularly pertains to a new and improved corner protector apparatus wherein the same is utilized to simultaneously protect corner portions of frangible sheet product during transport, as well as minimizing erosion of tether lines utilized to secure the sheet products in position.

2. Description of the Prior Art

In the transport and storage of frangible sheets, such as glass, various tether lines such as rope and the like are typically frayed and eroded during use due to the relatively sharp edges of the sheet members. The undesirable relative replacement of such tether lines requires additional maintenance, as well as the added danger of breakage of such tether lines permitting the repositioning of such sheets and their potential destruction. Prior art corner protectors have been utilized and may be found in U.S. Pat. No. 4,011,632 to MacDonald wherein corner protectors utilize strips utilizing longitudinal ribs spaced relative to one another to position a flexible strap therebetween.

U.S. Pat. No. 3,073,439 to Symmonds utilizes selectively adherable strip members securable to a stack of work pieces to position a strap member in a spaced relationship relative to the stack to minimize destruction of the stack during transport.

U.S. Pat. No. 3,152,693 to Anderson sets forth a guide for binding strap utilizing projecting ribs mounted to the guides for positioning straps in relationship to a stack of sheets to be transported.

U.S. Pat. No. 4,525,113 to Colman sets forth a series of guards utilizing rib members extending vertically upwardly relative to a support plate to position a chain and the like in a spaced relationship relative to a stack to be transported.

U.S. Pat. No. 3,209,706 to Broling sets forth an anchoring member utilizing relatively pre-formed corner portions to overlie a stack during transport.

As such, it may be appreciated that there continues to be a need for a new and improved corner protector apparatus set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of corner protector apparatus now present in the prior art, the present invention provides a corner protector apparatus wherein the same utilizes a flexible strip to overlie relatively sharp edges of a stacked sheet to minimize and avoid erosion of tether lines utilized to secure and maintain a sheet in position relative to a support platform. As such, the general purpose of the present invention, which will be described subsequently in greater detail, is to provide a new and improved corner protector apparatus which has all the advantages of the prior art corner protector apparatus and none of the disadvantages.

To attain this, the present invention provides an apparatus including an elongate flexible strip longitudinally aligned, including a first and second aperture directed through the strip adjacent a forward and rear end of the strip to receive a flexible tether line therethrough to secure a stack of frangible sheets against a support platform. A modification of the invention includes removal grommets directed through the openings to vary the effective diameter of each opening, and further may include a selectively securable positioning member onto a bottom surface of the strip to assist in alignment of the strip adjacent a corner of the aforenoted stack.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corner protector apparatus which has all the advantages of the prior art corner protector apparatus and none of the disadvantages.

It is another object of the present invention to provide a new and improved corner protector apparatus which may be easily and efficiently manufactured and marketed.

It is a further object of the present invention to provide a new and improved corner protector apparatus which is of a durable and reliable construction.

An even further object of the present invention is to provide a new and improved corner protector apparatus which is susceptible of a low cost of manufacture with regard to both materials and labor, and which accordingly is then susceptible of low prices of sale to the consuming public, thereby making such corner protector apparatus economically available to the buying public.

Still yet another object of the present invention is to provide a new and improved corner protector apparatus which provides in the apparatuses and methods of the prior art some of the advantages thereof, while simultaneously overcoming some of the disadvantages normally associated therewith.

Still another object of the present invention is to provide a new and improved corner protector apparatus wherein the same is readily securable and positionable relative to corner portions of sheet members to permit positioning and securement of the sheet members in a stacked relationship minimizing wear and erosion of an associated tether line or rope securing the sheet members in a stacked relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art corner protector apparatus.

FIG. 2 is an isometric illustration of a further example of a corner protector apparatus.

DESCRIPTION OF THE PREFERRED EMBODIMENT

Figure 3:
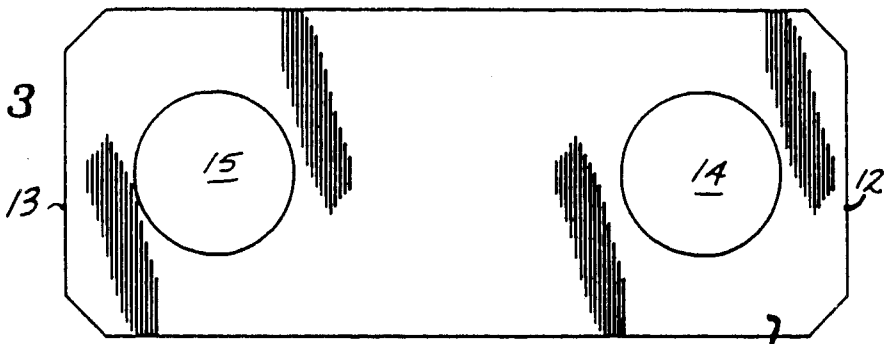
FIG. 3 is an orthographic top view of the instant invention.
Figure 4:
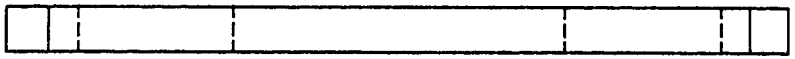
FIG. 4 is an orthographic side view, taken in elevation, of the instant invention.
Figure 5:
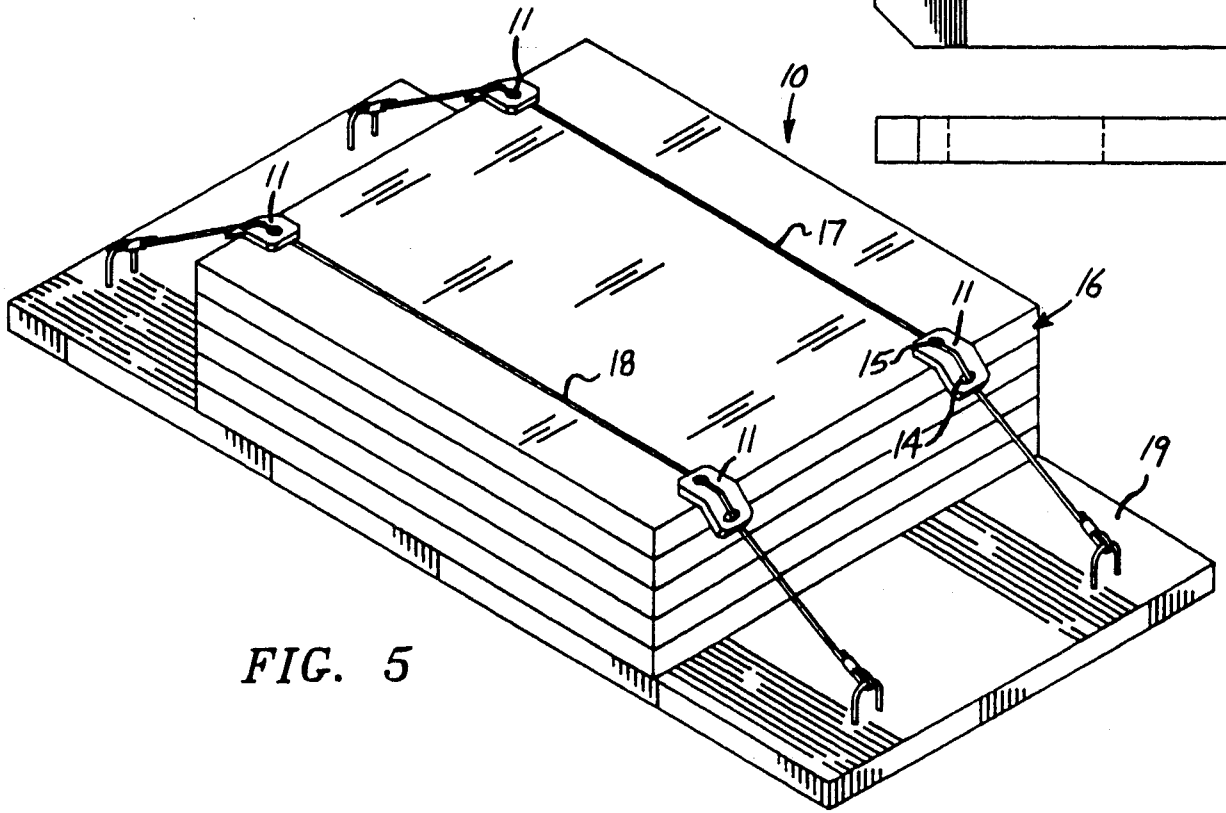
FIG. 5 is an isometric illustration of the instant invention in association with a sheet stack.

With reference now to the drawings, and in particular to FIGS. 1 to 12 thereof, a new and improved corner protector apparatus embodying the principles and concepts of the present invention and generally designated by the reference numeral 10 will be described.

FIG. 1 illustrates a prior art corner protector apparatus 1, wherein flexible members 3 position a strap 2 in an overlying relationship relative to a stack of work piece members. FIG. 2 illustrates a further prior art corner protector apparatus 4, wherein the protectors 5 utilize spaced ribs 6 to position a strap member 7 relative to a stack of sheets defining a bundle to secure the stack in a fixed relationship relative to one another.

More specifically, the corner protector apparatus 10 of the instant invention essentially comprises an elongate flexible longitudinally aligned strip member 11 formed of various material, such as leather, polymerics, and the like, to accommodate flexure and positioning of the strip as positioned on a stack 16 (see FIG. 5) of various sheets such as glass, metal, and the like. The strip 11 includes a forward first edge 12 and a rear second edge 13, with a first through-extending opening 14 and a second through-extending opening 15 orthogonally directed through the strip adjacent the first and second edges respectively. In use, a first flexible tether line 17 and a second flexible tether line 18 are utilized to secure the stack 16 to an underlying relatively rigid support 19. Each tether line is directed through the first and second openings 14 and 15, with the tether line positioned overlying a top surface of the strip 11 to space the tether line from corner contact with the stack 16 preventing unwarranted and accelerated erosion of the tether line during transport and storage of the stack of the sheet members defining the stack 16.

Figure 6:
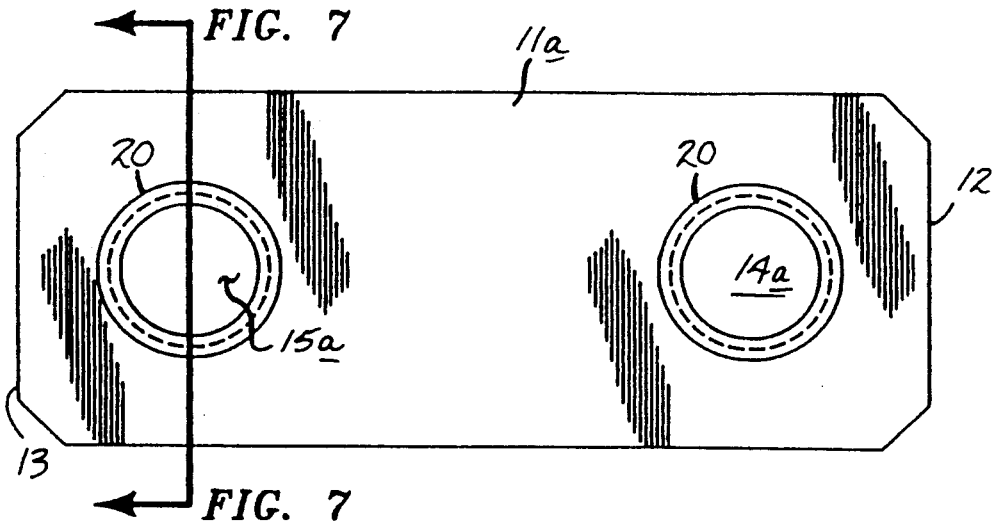
FIG. 6 is an orthographic top view of a modification of the instant invention.
Figure 7:
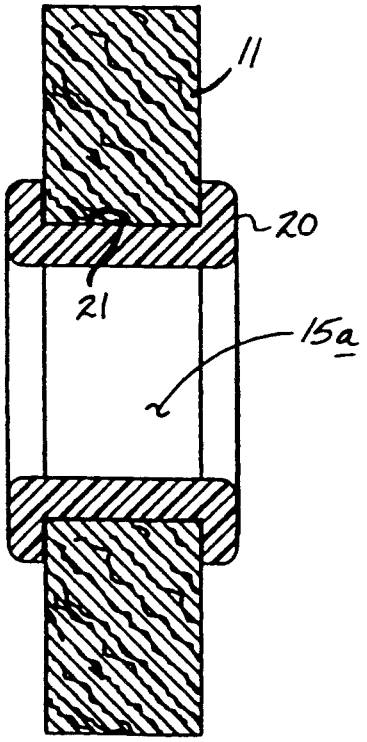
FIG. 7 is an orthographic view, taken along the lines 7—7 of FIG. 6, in the direction indicated by the arrows.
Figure 8:
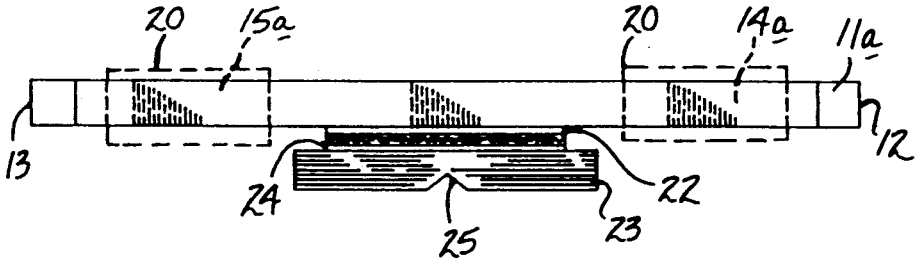
FIG. 8 is an orthographic side view of the modification of the instant invention utilizing a positioning member mounted to a bottom surface of the elongate strip.
Figure 9:
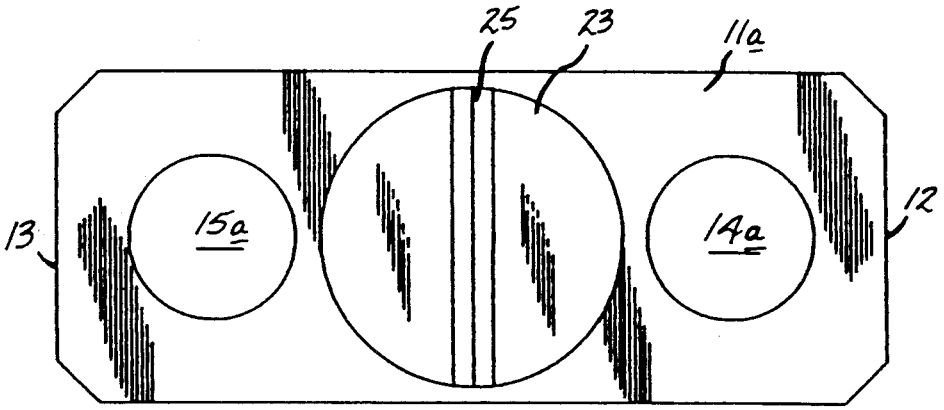
FIG. 9 is an orthographic bottom view of the instant invention, as illustrated in FIG. 8.

FIG. 6 illustrates a modified strip member 11*a* defining a respective first and second adjustable opening 14*a* and 15*a* adjacent the respective first and second end edges 12 and 13. A resilient grommet 20 is selectively directed through each of the openings 14*a* and 15*a* to effect dimensional modifications to the effective diameter of each of the openings. The grommets 20 are each formed with an encircling annular groove 21 formed throughout an exterior surface of each grommet to receive an annular edge of each opening 14*a* and 15*a* respectively therewithin to anchor each grommet within each respective opening to thereby accommodate various tether lines of various diameters therethrough minimizing slippage and repositioning of each strip relative to each tether line.

Figure 10:
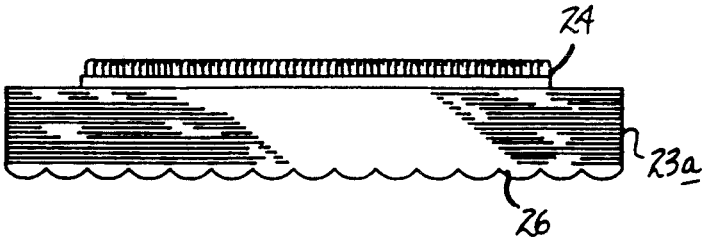
FIG. 10 is an orthographic side view, taken in elevation, of a modified positioning member utilized by the instant invention.
Figure 11:
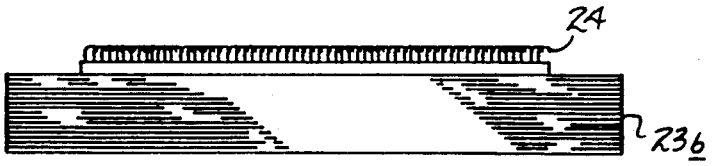
FIG. 11 is an orthographic side view, taken in elevation, of a further modified positioning member utilized by the instant invention.
Figure 12:
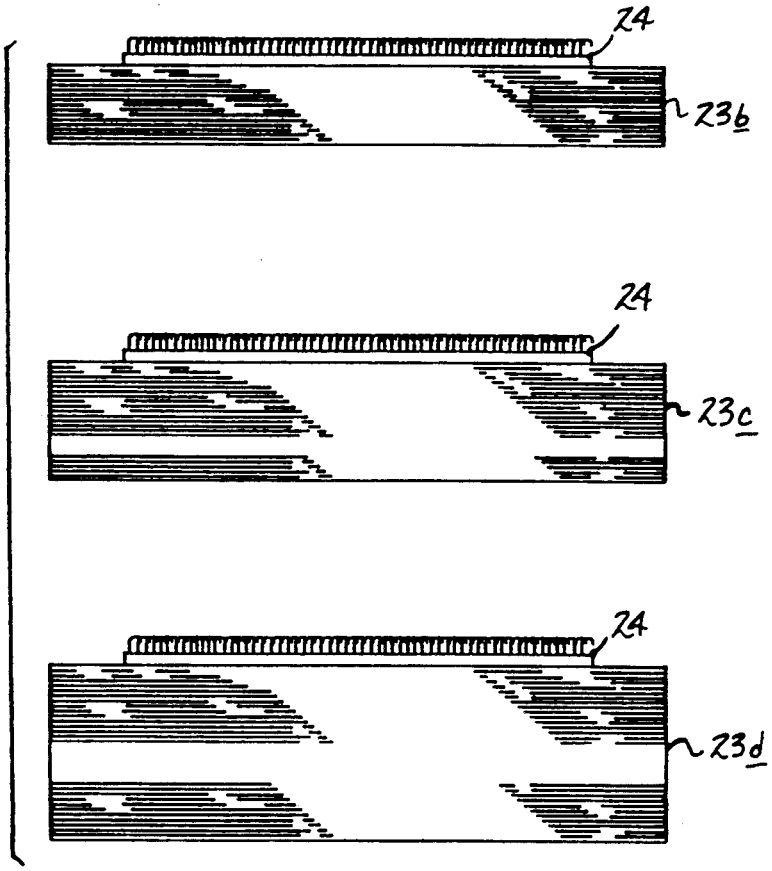
FIG. 12 is an orthographic side view of the modified positioning member in an array of thicknesses.

Further, the modified strip 11*a* includes a bottom surface with a first hook and loop fastener surface 22 fixedly formed thereon positioned between the first and second adjustable openings 14*a* and 15*a* on the bottom surface of the strip 11*a*. A positioning member 23 is thereby selectively securable to the first hook and loop fastener surface 22, wherein the positioning member 23 includes a second hook and loop fastener surface 24 formed to a bottom surface of positioning member 23, while a "V" shaped groove 25 is formed throughout a top surface of the positioning member 23, wherein the "V" shaped groove 25 is longitudinally aligned and positioned parallel to the respective first and second end edges 12 and 13 to receive a corner of an uppermost sheet of the stack 16 therewithin to fixedly anchor the modified strip 11*a* relative to the stack 16. FIG. 10 illustrates a modified positioning member 23*a* utilizing a ribbed bottom surface 23 to position the positioning member as desired about the stacked sheet, with positioning member utilizing the ribbed bottom surface 26 formed of parallel ribs that are utilized in a parallel relationship relative to the first and second end edges 12 and 13, as is the "V" shaped groove 25. FIG. 12 illustrates the use of further modified positioning members 23*b*, 23*c*, and 23*d* of various thicknesses to accommodate materials of various frangible nature as the positioning members 23*b*, 23*c*, and 23*d* are formed of a compressible material to accommodate shock and cushioning of the stack during its securement to the underlying support member 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A corner protector apparatus for securement overlying a stack of sheet members, the corner protector member arranged to receive an elongate flexible tether line therethrough, the corner protector member including, a first end edge spaced from and parallel to a second end edge, and a top surface spaced from and coextensive with an underlying bottom surface, and a first through-extending opening directed to the top surface and the bottom surface orthogonally therethrough adjacent the first end edge, and a second opening directed orthogonally to the top surface and bottom surface adjacent the second end edge, and the first opening and the second opening receiving the tether line therethrough to secure the stack to an underlying member, and wherein the first opening and the second opening each receive a replaceable grommet member.

2. A corner protector member as set forth in claim 1 wherein each grommet member includes a flexible, generally cylindrical grommet, wherein each grommet includes an annular groove formed about an exterior surface of each annular grommet, and each annular groove is of a predetermined width to complementarily receive an annular edge of each opening therewithin.

3. A corner protector apparatus as set forth in claim 2 wherein the bottom surface of the strip includes a first hook and loop fastener surface mounted thereon between the first and second opening, and a positioning member including a positioning member top surface and a positioning member bottom surface securable to the first hook and loop fastener surface, wherein the positioning member bottom surface includes a second hook and loop fastener surface selectively securable to the first hook and loop fastener surface.

4. A corner protector apparatus as set forth in claim 3 wherein the positioning member top surface includes a "V" shaped groove directed therethrough, wherein the "V" shaped groove is formed coextensively with the positioning member top surface and arranged parallel to the first end edge and the second end edge positioned medially of the first end edge and the second edge.

5. A corner protector apparatus as set forth in claim 4 wherein each positioning member is compressible to accommodate shock during securement of the stack to the underlying support member.

* * * * *